US012326265B2

(12) United States Patent
Yaji et al.

(10) Patent No.: US 12,326,265 B2
(45) Date of Patent: Jun. 10, 2025

(54) OUTDOOR UNIT FOR AIR-CONDITIONING APPARATUS

(71) Applicant: Mitsubishi Electric Corporation, Tokyo (JP)

(72) Inventors: Yoshikazu Yaji, Tokyo (JP); Masaru Shinozaki, Tokyo (JP); Ryuji Momose, Tokyo (JP); Koichi Arisawa, Tokyo (JP); Takaaki Takahara, Tokyo (JP); Keisuke Uemura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 121 days.

(21) Appl. No.: 18/276,888

(22) PCT Filed: Mar. 10, 2021

(86) PCT No.: PCT/JP2021/009566
§ 371 (c)(1),
(2) Date: Aug. 11, 2023

(87) PCT Pub. No.: WO2022/190268
PCT Pub. Date: Sep. 15, 2022

(65) Prior Publication Data

US 2024/0125489 A1 Apr. 18, 2024

(51) Int. Cl.
*F24F 1/46* (2011.01)
*F24F 1/16* (2011.01)
(Continued)

(52) U.S. Cl.
CPC ..... *F24F 1/46* (2013.01); *F24F 1/24* (2013.01); *F24F 1/16* (2013.01); *F24F 1/56* (2013.01)

(58) Field of Classification Search
CPC ..... F24F 1/46; F24F 1/24; F24F 1/16; F24F 1/56
(Continued)

(56) References Cited

U.S. PATENT DOCUMENTS

2010/0193164 A1 8/2010 Wakatsuki
2020/0378626 A1* 12/2020 Chothave ..... F24F 1/0326
2022/0082271 A1 3/2022 Watanabe

FOREIGN PATENT DOCUMENTS

DE 112019006948 T5 12/2021
JP H10-122601 A 5/1998
(Continued)

OTHER PUBLICATIONS

International Search Report and Written Opinion mailed on May 11, 2021, received for PCT Application PCT/JP2021/009566, filed on Mar. 10, 2021, 10 pages including English Translation.
(Continued)

*Primary Examiner* — Steve S Tanenbaum
(74) *Attorney, Agent, or Firm* — XSENSUS LLP

(57) ABSTRACT

This disclosure provides an outdoor unit for an air-conditioning apparatus with improved reliability.
The outdoor unit (1000) includes a housing whose inside is divided into a fan chamber (110) and a machine chamber (120). A compressor and a reactor that are heat-generating components are provided in a lower area of the machine chamber (120). An electric board (50) including a printed circuit board (51) and an electric component (52), and an electric component box (10) constituted by an inner box (11) and an outer box (12) and accommodating the electric board are provided above the heat-generating components. A lower face of the inner box (first thermal insulation plate) and a lower face of the outer box (second thermal insulation plate) constitute a double thermal insulation plate (10*a*).

9 Claims, 9 Drawing Sheets

(51) Int. Cl.
*F24F 1/24* (2011.01)
*F24F 1/56* (2011.01)

(58) Field of Classification Search
USPC ..... 62/259.2
See application file for complete search history.

(56) References Cited

FOREIGN PATENT DOCUMENTS

| | | | | |
|---|---|---|---|---|
| JP | H11-2435 | A | | 1/1999 |
| JP | 2000-275372 | A | | 10/2000 |
| JP | 2006-300431 | A | | 11/2006 |
| JP | 2008-157587 | A | | 7/2008 |
| JP | 2010-007982 | A | | 1/2010 |
| JP | 2011080723 | A | * | 4/2011 |
| WO | 2009/041424 | A1 | | 4/2009 |

OTHER PUBLICATIONS

Office Action dated Nov. 22, 2023 issued in corresponding DE patent application No. 112021007237.4, 6 pages (and English translation).

* cited by examiner (A)

(B)

(A)

(B)

OUTDOOR UNIT FOR AIR-CONDITIONING APPARATUS

CROSS-REFERENCE TO RELATED APPLICATION

The present application is based on PCT filing PCT/JP2021/009566, filed Mar. 10, 2021, the entire contents of which are incorporated herein by reference.

TECHNICAL FIELD

The present disclosure relates to an outdoor unit for an air-conditioning apparatus.

BACKGROUND ART

To increase the cooling effect on an electric board provided in an outdoor unit for an air-conditioning apparatus, there have been techniques for ventilating, with outside air, an electric component box accommodating the electric board (for example, refer to Patent Literature 1).

CITATION LIST

Patent Literature

Patent Literature 1: Japanese Unexamined Patent Application Publication No. 11-002435

SUMMARY OF INVENTION

Technical Problem

However, such ventilation of the electric component box with outside air has a problem of reliability reduction because, for example, dust clings to the electric board accommodated in the electric component box and thus degrades electric components constituting the electric board.

The present disclosure has been made to solve the above-described problem, and an object thereof is to increase the reliability of an outdoor unit for an air-conditioning apparatus.

Solution to Problem

An outdoor unit for an air-conditioning apparatus of an embodiment of the present disclosure includes: a housing whose inside is divided into a fan chamber and a machine chamber by a partition plate; a heat exchanger provided in the fan chamber; a fan that sucks air from outside the housing into the fan chamber; a heat-generating component provided in the machine chamber; an electric board provided above the heat-generating component and including a printed circuit board and an electric component; and a double thermal insulation plate provided between the heat-generating component and the electric board and including a first thermal insulation plate and a second thermal insulation plate disposed below the first thermal insulation plate with a space interposed between the first thermal insulation plate and the second thermal insulation plate.

Advantageous Effects of Invention

The outdoor unit for an air-conditioning apparatus according to an embodiment of the present disclosure can exhibit an effect of increasing the reliability.

DESCRIPTION OF EMBODIMENTS

Hereinafter, embodiments will be described based on the drawings. Note that, in the following drawings, the parts similar to or equivalent to one another are denoted by the same reference signs, and the descriptions thereof will not be repeated.

Embodiment 1

An outdoor unit for an air-conditioning apparatus of Embodiment 1 will be described with reference to FIGS. 1 to 6.

Figure 1:
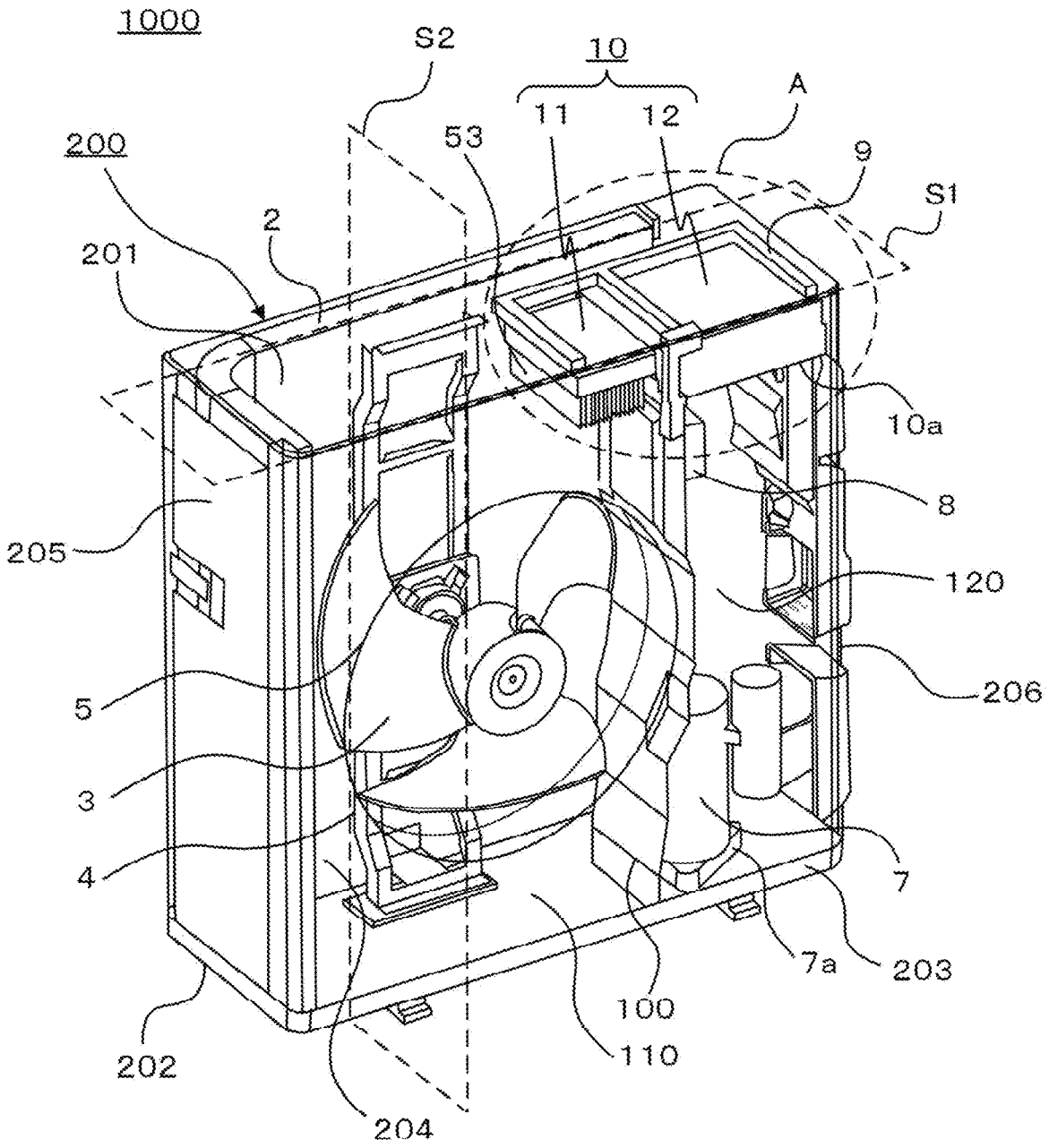
FIG. 1 is a transparent perspective view of an outdoor unit of Embodiment 1 through a portion of a housing when viewed at a position in front of the outdoor unit.
Figure 2:
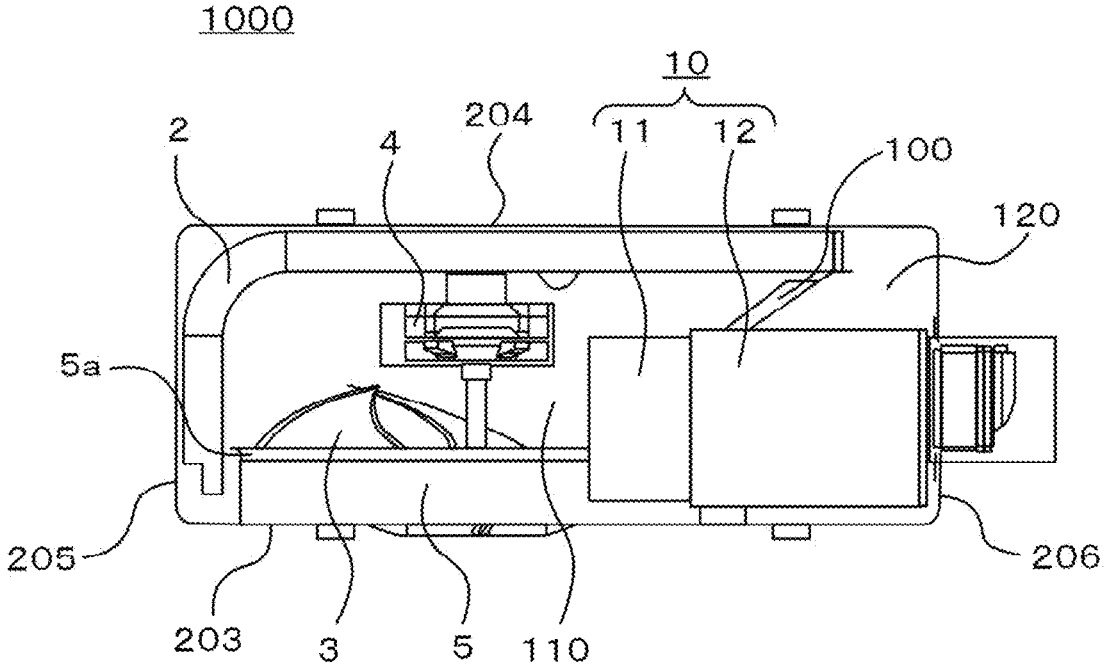
FIG. 2 is a top view of section 51 of the outdoor unit of Embodiment 1.

First, the overall configuration of the outdoor unit of the air-conditioning apparatus of Embodiment 1 will be described with reference to FIGS. 1 to 3. FIG. 1 is a transparent perspective view of an outdoor unit 1000 of Embodiment 1 through a portion of a housing 200 when viewed at a position in front of the outdoor unit 1000. FIG. 2 is a top view of section S1 of the outdoor unit 1000 in FIG. 1, and FIG. 3 illustrates section S2 of the outdoor unit 1000 in FIG. 1 when viewed from the fan chamber side.

Note that, in the present disclosure, for convenience of description, the sides related to the outdoor unit 1000 in FIG. 1 when the viewer faces the paper sheet of the figure are defined as follows: a place closer to a front panel 203 positioned on the near side is sometimes referred to as the "front side"; a place closer to a back panel 204 positioned on the far side is sometimes referred to as the "back side"; a place closer to a top panel 201 positioned on the upper side is sometimes referred to as the "upper side"; a place closer to a bottom panel 202 positioned on the lower side is sometimes referred to as the "lower side"; a place closer to a fan chamber 110 positioned on the left side is sometimes referred to as the "fan chamber side"; and a place closer to a machine chamber 120 positioned on the right side is sometimes referred to as the "machine chamber side". Similarly, when the viewer faces the paper sheet of FIG. 1, the upward direction is sometimes referred to as "above", and the downward direction is sometimes referred to as "below".

The air-conditioning apparatus described in Embodiment 1 is provided with the outdoor unit 1000 (illustrated in FIG. 1) that is installed outdoors and an indoor unit (not illustrated) that is installed indoors. The outdoor unit 1000 of Embodiment 1 is connected to the indoor unit by refrigerant pipes to constitute a refrigeration cycle. The outdoor unit 1000 is connected to the indoor unit also by a power line and a signal line used for the operational control of the refrigeration cycle.

Figure 3:
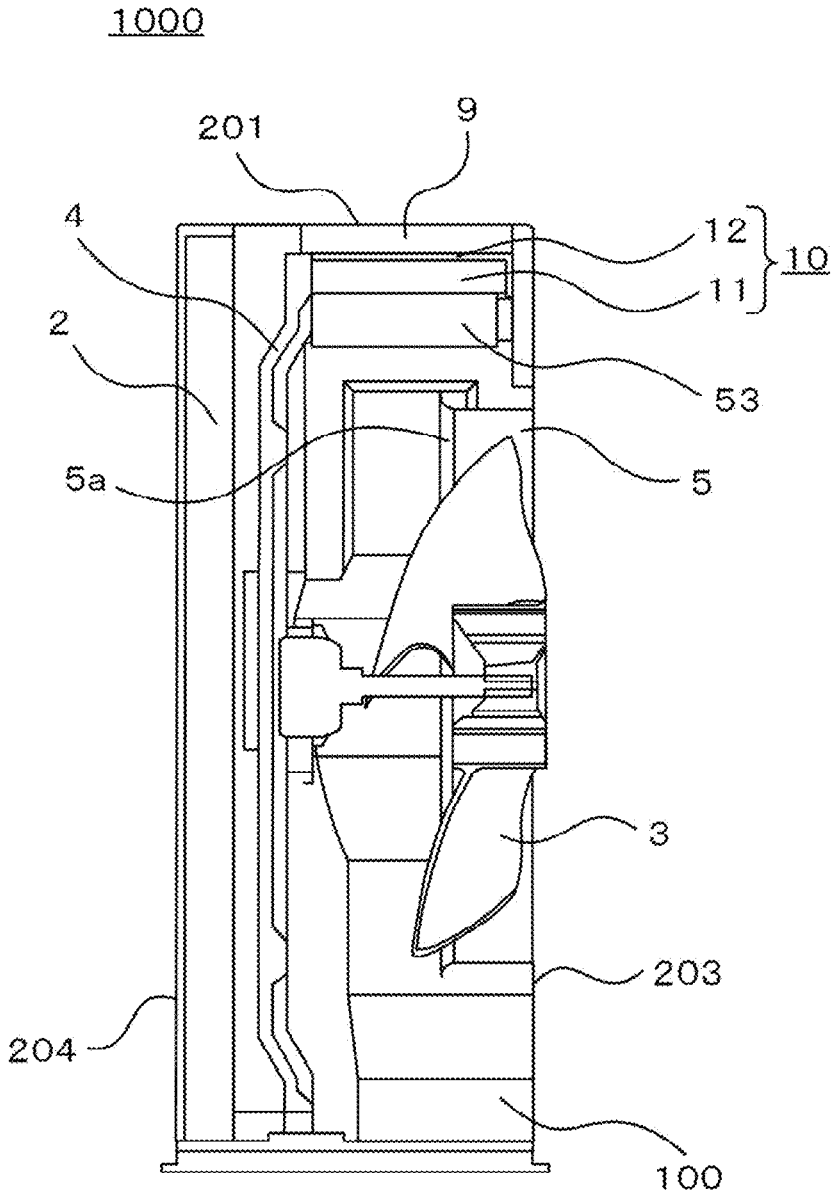
FIG. 3 illustrates section S2 of the outdoor unit of Embodiment 1 when viewed from the fan chamber side.

As FIGS. 1 to 3 illustrate, the outdoor unit 1000 includes the housing 200 whose inside is divided into the fan chamber 110 and the machine chamber 120 by a partition plate 100, a heat exchanger 2 provided in the fan chamber 110, a fan 3 provided in the fan chamber 110 and used for sucking in air from outside the housing 200 and discharging air, a compressor 7 and a reactor 8 that are provided in a lower area of the machine chamber 120 and are heat-generating components, and an electric component box 10 accommodating an electric board 50 (not illustrated in FIGS. 1 to 3). The electric component box 10 includes, as a constituent thereof, a double thermal insulation plate 10*a* provided between the electric board 50, and the compressor 7 and the reactor 8 that are heat-generating components.

As FIG. 1 illustrates, the housing 200 is constituted by the top panel 201, the bottom panel 202, the front panel 203, the back panel 204, a side panel 205, and a side panel 206. Each of the panels constituting the housing 200 can be formed by, for example, sheet-metal working. Note that FIG. 1 is a transparent view through the top panel 201 and the front panel 203 that are parts of the housing 200. In the housing 200, the top panel 201, the bottom panel 202, the front panel 203, the back panel 204, the side panel 205, and the side panel 206 may be individual panels, or two or more panels may be formed as one body, that is, for example, the back panel 204 and the side panel 205 may be formed as one body.

The housing 200 has an inlet port and an exhaust port through which outside air is sucked in and discharged by the fan 3. More specifically, the side panel 205 and the back panel 204 have plural inlet ports being through holes to allow outside air to flow into the fan chamber 110. The side panel 206 also has an inlet port being a through hole to allow outside air to flow into the machine chamber 120. On the other hand, an exhaust port is formed, in the front panel 203 in FIG. 1, in an area surrounded by a bell mouth 5. Note that the flow of air in the outdoor unit 1000 will be described later.

The partition plate 100 that is formed by, for example, sheet-metal working is provided in the housing 200. As FIG. 1 and FIG. 2 illustrate, the partition plate 100 divides the inside of the housing 200 into two spaces. One of the two spaces is the fan chamber 110 positioned on the left side when the viewer faces FIG. 1. The other space is the machine chamber 120 positioned on the right side when the viewer faces FIG. 1.

As FIG. 1 illustrates, for example, the heat exchanger 2, the fan 3, and the bell mouth 5 are disposed in the fan chamber 110. On the other hand, for example, the compressor 7 and the reactor 8 that are heat-generating components are disposed in the machine chamber 120. In addition, the electric component box 10 accommodating the electric board 50 is laid across the fan chamber 110 and the machine chamber 120 as FIG. 1 and FIG. 2 illustrate.

The details of the configuration of a portion of the outdoor unit 1000 on the fan chamber 110 side will be described.

As FIG. 1 and FIG. 2 illustrate, the heat exchanger 2 is formed in an L shape in sectional view and disposed along the side panel 205 and the back panel 204 of the housing 200. Although not illustrated, the heat exchanger 2 is constituted by plural fins made of metal and plural refrigerant pipes passing through the plural fins. The heat exchanger 2 is a constituent of the refrigeration cycle of the air-conditioning apparatus and is connected to other constituents such as the compressor 7 by refrigerant pipes.

As FIG. 1 illustrates, the fan 3 is fixed to a support board 4 provided in the housing 200, by, for example, being screwed thereto. The fan 3 is rotated to suck outside air into the housing 200 through the above-described inlet ports of the housing 200 and to discharge the air inside the housing 200 through the exhaust port of the housing 200. Thus, the operation of the fan 3 generates an airflow.

As FIG. 1 and FIG. 3 illustrate, the bell mouth 5 is provided on the inner side relative to the front panel 203 so as to surround the exhaust port formed in the front panel 203. As FIG. 3 illustrates, a peripheral portion of the bell mouth 5 has a protruding portion 5*a* that has an annular shape and protrudes inside of the housing 200. The protruding portion 5*a* guides the airflow generated by the fan 3 toward the exhaust port.

Next, the details of the configuration of a portion of the outdoor unit 1000 on the machine chamber 120 side will be described.

As FIG. 1 illustrates, the compressor 7 is provided in the machine chamber 120 and fixed to the bottom panel 202 with a vibration-proof rubber 7*a* interposed therebetween. The compressor 7 is connected to other constituents of the refrigeration cycle such as the heat exchanger 2 by refrigerant pipes and circulates refrigerant through the refrigeration cycle. The compressor 7 is a heat-generating component whose operation generates heat.

As FIG. 1 illustrates, the reactor 8 is provided, in the machine chamber 120, above the compressor 7 in a fixed manner. Although not illustrated, the reactor 8 is constituted by a core including electromagnetic steel sheets layered on one another, a coil of, for example, a copper wire wound around the core, and a base plate made of metal and welded to an end face of the core. The base plate of the reactor 8 is fixed to the partition plate 100 by a fixing tool such as a screw. The reactor 8 is for improving the power factor of an alternating-current power source. The reactor 8 is a heat-generating component whose operation generates heat.

In the machine chamber 120, although not illustrated, there are further disposed, for example, an expansion valve, a four-way valve, and refrigerant pipes that constitute the refrigeration cycle and electric wires for connecting between the components.

In addition, the electric component box 10 is disposed in part A in FIG. 1. A cushioning 9 made of, for example, a foam resin material is provided between the electric component box 10 and the top panel 201. The electric component box 10 includes, as a constituent thereof, the double thermal insulation plate 10*a* and accommodates the electric board 50 thereinside.

Figure 4:
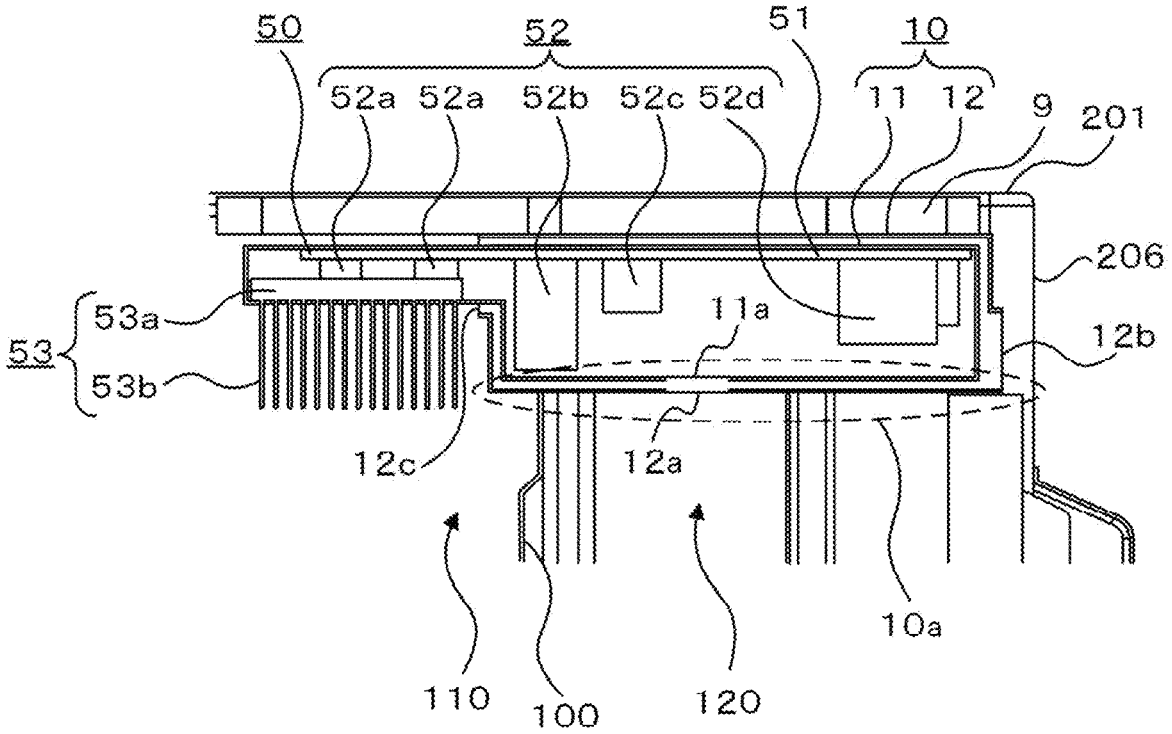
FIG. 4 is a front view of part A of the outdoor unit of Embodiment 1.
Figure 5:
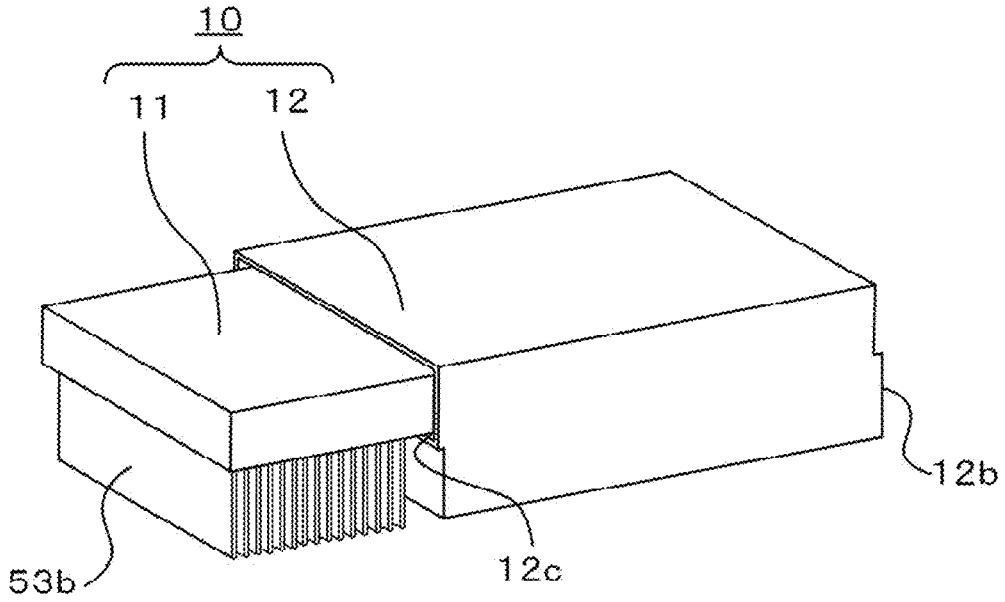
FIG. 5 includes perspective views of an electric component box provided in the outdoor unit of Embodiment 1.
Figure 5:
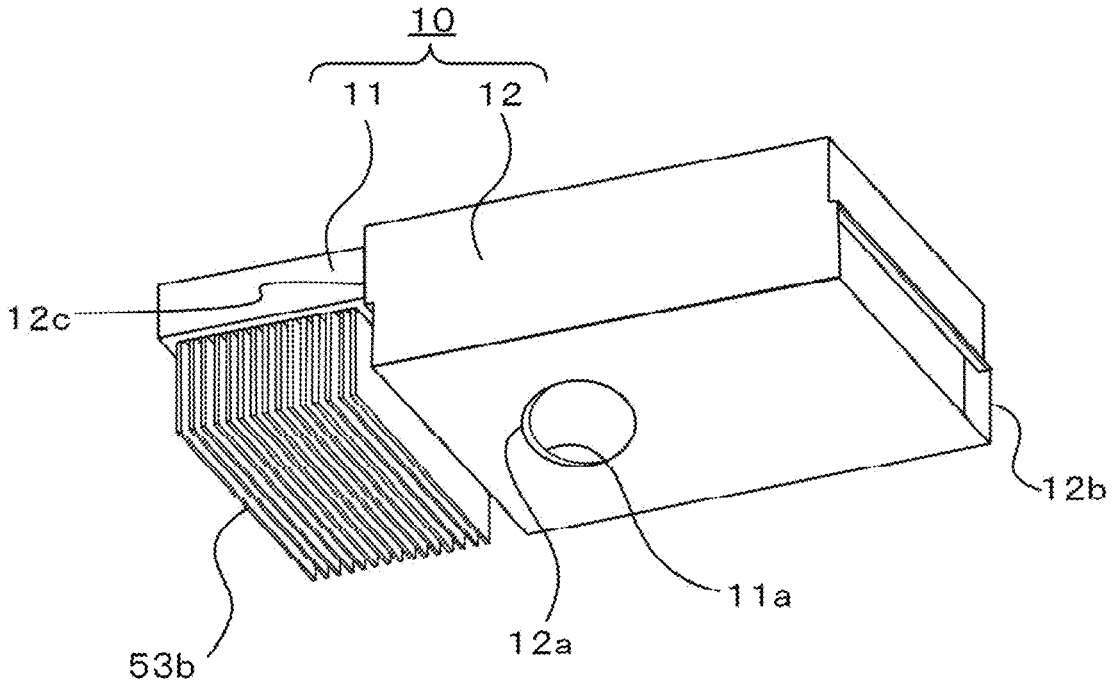

Here, the details of part A in FIG. 1 will be described with reference to FIGS. 4 to 6. FIG. 4 is a front view of part A of the outdoor unit 1000 of Embodiment 1. FIG. 5 includes perspective views of the electric component box 10 provided in the outdoor unit 1000, and FIG. 6 includes perspective views of an inner box 11 of the electric component box 10.

As FIG. 4 and FIG. 5 illustrate, the electric component box 10 is constituted by the inner box 11 and an outer box 12. As FIG. 4 illustrates, the electric component box 10 includes the double thermal insulation plate 10*a* constituted by a lower face of the inner box 11 (first thermal insulation plate) and a lower face of the outer box 12 (second thermal insulation plate). The electric board 50 is accommodated in the inner box 11. The outer box 12 covers at least a portion of the inner box 11 on the machine chamber side.

As FIG. 4 illustrates, the inner box 11 is laid across the fan chamber 110 and the machine chamber 120. As FIGS. 4 to 6 illustrate, a portion of the lower face of the inner box 11 on the machine chamber side has a pull-out port portion 11*a* for electric wires (not illustrated) required for electrical connection between the electric board 50 and components such as the fan 3, the compressor 7, and the reactor 8. Note that, although a gap is left between the pull-out port portion 11*a* and the electric wires, the sealed space of the inner box 11 can be kept sealed by closing the gap with an elastic material (not illustrated), such as a spongiform cushioning made of a foam resin material, for example. In addition, the pull-out port portion 11*a* is not limited to a single pull-out port portion formed in the lower face of the inner box 11 and may be formed in, for example, a side face. Alternatively, plural pull-out port portions 11*a* may be formed.

Figure 6:
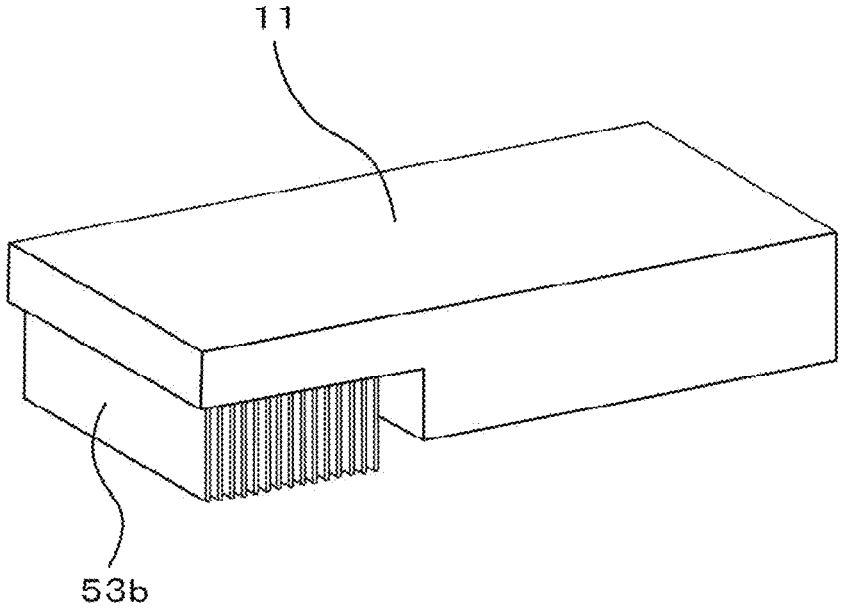
FIG. 6 includes perspective views of an inner box of the electric component box provided in the outdoor unit of Embodiment 1.
Figure 6:
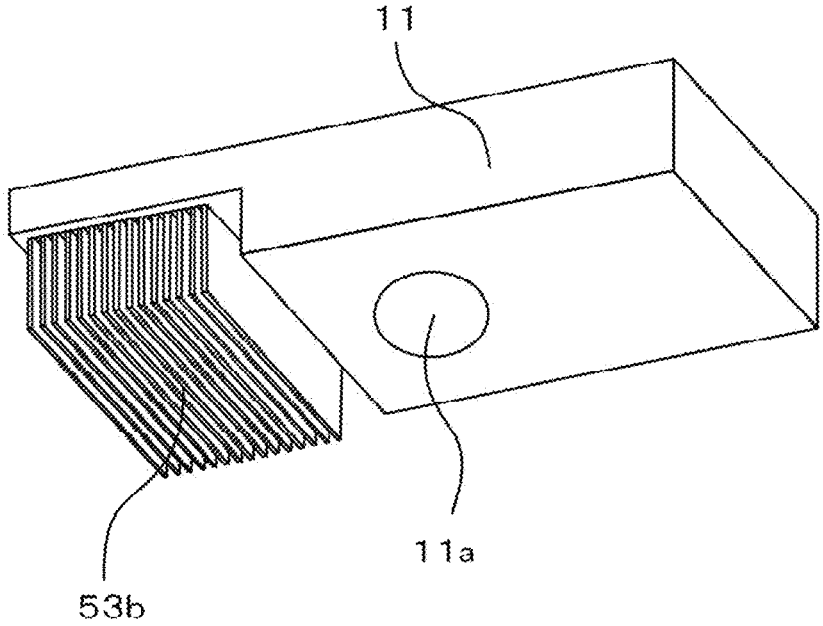

As FIGS. 4 to 6 illustrate, a heat sink 53 is attached to the inner box 11 so that heat transfer fins 53*b* are exposed outside the inner box 11. As FIG. 4 illustrates, a box shape for accommodating the electric board 50 is formed by the inner box 11 and a heat sink base plate 53*a* of the heat sink 53. The inner box 11 is constituted by plural plate-shaped materials and made of, for example, a metal material. Specifically, the inner box 11 can be formed as follows. For example, a box shape whose upper side is open is formed by sheet-metal bending, and a lid cover is screwed thereto from above. Note that FIG. 6 and other figures illustrate the shape of the inner box 11 in a simple manner.

As FIG. 4 illustrates, the outer box 12 is laid across the fan chamber 110 and the machine chamber 120. As FIG. 4 and FIG. 5 illustrate, the lower face of the outer box 12 has a pull-out port portion 12*a* for the electric wires (not illustrated) required for electrical connection between the electric board 50 and components such as the fan 3, the compressor 7, and the reactor 8. With the above-described configuration, the electric wires are caused to pass through the pull-out port portion 11*a* of the inner box 11 and the pull-out port portion 12*a* of the outer box 12, and the electric board 50 accommodated in the electric component box 10 can thereby be connected to the components, such as the compressor 7 and the reactor 8, that are provided outside the electric component box 10.

The outer box 12 is constituted by plural plate-shaped materials. In the outer box 12, for example, the lower face is made of a resin material having a low thermal conductivity, and the other faces are made of a metal material. Specifically, the outer box 12 can be formed as follows. For example, the metal part thereof is formed by sheet-metal bending and is screwed to the resin part thereof to form a box shape having openings 12*b* and 12*c* as FIG. 5 illustrates. Note that FIG. 5 and other figures illustrate the shape of the outer box 12 in a simple manner.

A portion of the outer box 12 on the right side in front view, that is, on the machine chamber side has the opening 12*b* allowing air to flow in through the inlet port of the side panel 206. In addition, a portion of the outer box 12 on the left side in front view, that is, on the fan chamber side has the opening 12*c* allowing air to flow out into the fan chamber 110. As FIG. 4 illustrates, the opening 12*b* is formed inside the machine chamber 120, and the opening 12*c* is formed inside the fan chamber 110. In addition, the partition plate 100 supports the outer box 12 to suppress the outer box 12 from falling under its own weight.

A uniform gap of about 5 mm is formed between the inner box 11 and the outer box 12. However, each of the inner box 11 and the outer box 12 is supported in a fixed manner, and the inner box 11 and the outer box 12 may be in contact with one another in an area at such a support part. As FIG. 4 illustrates, such a space between the inner box 11 and the outer box 12 allows the air that flows from the opening 12*b* and passes through the space between the inner box 11 and the outer box 12, to flow out through the opening 12*c*. That is, the machine chamber 120 and the fan chamber 110 are considered to communicate with one another.

As FIG. 4 illustrates, the electric component box 10 includes the double thermal insulation plate 10*a* constituted by the lower face of the inner box 11 (first thermal insulation plate) and the lower face of the outer box 12 (second thermal insulation plate). The double thermal insulation plate 10*a* is provided between the electric board 50, and the compressor 7 and the reactor 8 that are heat-generating components. More specifically, the double thermal insulation plate 10*a* is disposed above the compressor 7 and the reactor 8 that are provided in the machine chamber 120 and are heat-generating components, and below the electric board 50. As described above, there is a gap (space) of about 5 mm between the lower face of the inner box 11 (first thermal insulation plate) and the lower face of the outer box 12 (second thermal insulation plate) that constitute the double thermal insulation plate 10*a*. Moreover, the lower face of the inner box 11 (first thermal insulation plate) is made of, for example, a metal material, and the lower face of the outer box 12 (second thermal insulation plate) is made of, for example, a resin material. That is, the lower face of the outer box 12 (second thermal insulation plate) is made of a material having a lower thermal conductivity than the lower face of the inner box 11 (first thermal insulation plate).

The electric board 50 is accommodated in the electric component box 10 constituted by the above-described inner box 11 and outer box 12. The electric board 50 includes a printed circuit board 51 and plural electric components 52 mounted on the printed circuit board 51 (on the lower side relative to the printed circuit board 51). The electric board 50 controls the power source of the air-conditioning apparatus and operations of equipment such as the compressor 7.

As FIG. 4 illustrates, the printed circuit board 51 is a plate-shaped circuit board. The printed circuit board 51 is provided so that one side thereof faces the upper face of the inner box 11 of the electric component box 10. Note that the printed circuit board 51 may be any board on which electric components can be mounted and is not limited to a printed circuit board.

As FIG. 4 illustrates, the plural electric components 52 are, for example, two power source control components 52*a*, a capacitor 52*b*, a resistor 52*c*, and a coil 52*d*. In the plural electric components 52, the power source control components 52*a* are power devices and provided on the fan chamber side. In addition, the heat sink 53 is attached to the power source control components 52*a*. Note that such a specific configuration of the electric components 52 here is an example and is not the only option.

Each of the power source control components 52*a* is attached to the printed circuit board 51 with a spacer of resin (not illustrated) interposed therebetween. A terminal of the power source control component 52*a* is soldered to the printed circuit board 51. The power source control component 52*a* generates the largest amount of heat among the plural electric components 52 mounted on the printed circuit board 51.

The heat sink 53 for transferring the heat generated from the power source control components 52*a* is attached to the face of each of the power source control components 52*a* (on the lower side relative to the power source control component 52*a*) opposite from the face that is soldered to the printed circuit board 51. The heat sink 53 is constituted by the heat sink base plate 53*a* and the plural heat transfer fins 53*b*.

More specifically, in the heat sink 53, the plural heat transfer fins 53*b* are disposed on one side of the heat sink base plate 53*a*. Each of the heat transfer fins 53*b* is a plate-shaped material extending vertically downward from the heat sink base plate 53*a* and having rectangular heat transfer surfaces on both sides. Such heat transfer fins 53*b* are arranged at regular spacings. The other side of the heat sink base plate 53*a*, that is, the face opposite from the face on which the heat transfer fins 53*b* are provided is pressed against the power source control components 52*a* with a thermally conductive grease or a thermally conductive sheet interposed therebetween.

Note that, although the heat sink 53 is supported by the inner box 11 in Embodiment 1, this configuration is not the only option. For example, a peripheral portion of the heat sink base plate 53*a* may be fixed to the inner box 11 with a heat sink holder of resin (not illustrated) interposed therebetween and may be supported by the inner box 11 downward, that is, in the gravity direction. In this case, the heat sink holder is fixed to the inner box 11 by, for example, screws.

Next, the flow of air during an operation of the outdoor unit 1000 will be described.

First, the fan 3 provided in the fan chamber 110, by the operation thereof, generates an airflow that flows from outside the outdoor unit 1000 into the fan chamber 110. More specifically, outside air is sucked into the fan chamber 110 through the inlet ports formed in the side panel 205 and the back panel 204 and exchanges heat with the refrigerant flowing through the refrigerant pipes of the heat exchanger 2. Here, when the air-conditioning apparatus performs a cooling operation, the heat of the refrigerant in the heat exchanger 2 of the outdoor unit 1000 is transferred to the air, and the temperature of the air passing through the heat exchanger 2 thereby becomes higher than the outside air temperature. On the other hand, when a heating operation is performed, heat is transferred from the air to the refrigerant, and the temperature of the air passing through the heat exchanger 2 thereby becomes lower than the outside air temperature.

The air that has flowed into the fan chamber 110 after passing through the heat exchanger 2 is guided by the bell mouth 5 having a recess in an inner side portion and is discharged outside the outdoor unit 1000 through the exhaust port of the front panel 203. At this time, a portion of the airflow passes through the heat transfer fins 53B of the heat sink 53, and heat transfer of the heat transfer fins 53B is thereby promoted.

Here, the air pressure in the fan chamber 110 is lowered by the fan 3 discharging the air in the fan chamber 110, and the air pressure in the outer box 12 communicating with the fan chamber 110 thereby becomes higher than the air pressure in the fan chamber 110 and lower than the outside air pressure. Thus, the operation of the fan 3 generates an airflow that flows toward the inside of the housing 200 from the inlet port of the side panel 206. As described above, the air that has flowed into the machine chamber 120 through the inlet port of the side panel 206 passes through the space between the outer box 12 and the inner box 11 and flows into the fan chamber 110, and the air is then guided by the bell mouth 5 and discharged through the exhaust port of the front panel 203.

Effects of the outdoor unit 1000 for the air-conditioning apparatus having the above-described configuration will be described.

When the electric board is energized to control an operation of the refrigeration cycle for the purpose of controlling an operation of the air-conditioning apparatus including the outdoor unit and the indoor unit, the electric components such as the power source control component generate heat. Here, although generating the largest amount of heat among the plural electric components, the power source control component can be cooled by the heat sink. On the other hand, other electric components such as the capacitor, the resistor, and the coil generate a smaller amount of heat than the power source control component, and the heat generated by the electric components themselves can be naturally air-cooled.

Here, the compressor and the reactor are disposed in a lower area of the machine chamber. The compressor and the reactor are heat-generating components and have temperatures higher than the electric components such as the capacitor, the resistor, and the coil. Moreover, during the cooling operation, because the air passing through the heat exchanger has a temperature about 10 degrees C. higher than the outside air temperature, the partition plate provided in the housing has a temperature higher than the outside air and thus raises the temperature in the machine chamber. Thus, especially during the cooling operation, the temperatures of the electric components constituting the electric board are increased in an environment whose temperature has been increased relative to the outside air.

Thus, the outdoor unit 1000 of the air-conditioning apparatus of Embodiment 1 includes the electric component box 10 accommodating the electric board 50, and the electric component box 10 includes, as a constituent thereof, the double thermal insulation plate 10*a* provided between the electric board 50, and the compressor 7 and the reactor 8 that are heat-generating components. By the outdoor unit 1000 including such a double thermal insulation plate 10*a*, the electric components 52 constituting the electric board 50 are hardly affected by the heat from the compressor 7 and the reactor 8 that are heat-generating components, and the outdoor unit 1000 can exhibit an effect of improving the reliability.

More specifically, the inner box 11 and the outer box 12, with the double structure, blocks the heat of the targeted heat source, and, on top of this, an air layer formed between the inner box 11 and the outer box 12 can further improve the thermal insulation performance. In addition, in the double thermal insulation plate 10*a*, the lower face of the outer box 12, that is, a plate facing the heat-generating components is made of resin and thus has a lower thermal conductivity than metal, and an effect of achieving a higher thermal insulation effect can thereby be exhibited.

In addition, in the electric components 52 disposed on the machine chamber 120 side, a malfunction that occurs due to a short circuit and corrosion caused by dust clinging, change in humidity, or other reasons may lead to reliability reduction. Because being installed in various outdoor environments, the outdoor unit 1000 is preferably not exposed to outside air so that dust or other substances are suppressed from clinging to the electric components mounted on the electric board 50 as much as possible.

Thus, in the outdoor unit 1000 of the air-conditioning apparatus of Embodiment 1, the inner box 11 accommodating the electric board 50 forms a sealed space, and dust and outside air can thereby be suppressed from affecting; thus, an effect of further improving the reliability can be exhibited. In addition, although the temperatures of the electric components 52 constituting the electric board 50 may be increased by the inner box 11 being sealed, an airflow that is generated in the space between the inner box 11 and the outer box 12 as described above can promote heat transfer of a surface of the inner box 11, and an effect of reducing temperature rise of the electric components 52 can thereby be exhibited.

With the sealed space formed by the inner box 11, the outdoor unit 1000 of the air-conditioning apparatus of Embodiment 1 can further exhibit an effect of suppressing an electric noise that is generated from the electric board 50.

Moreover, when a flammable refrigerant such as propane serves as the refrigerant circulating the refrigeration cycle, the outdoor unit 1000 of the air-conditioning apparatus of Embodiment 1, with the inner box 11 that forms the sealed space, can exhibit an effect of preventing ignition even if a leakage is cased due to a malfunction.

Note that, although the space between the inner box 11 and the outer box 12 is a uniform gap of about 5 mm in Embodiment 1, this is not the only option, and the space may be a gap of about 10 mm. In addition, the gap is not necessarily uniform, and, for example, a gap formed below the inner box 11 may be smaller than a gap formed above the inner box 11. With this configuration, heat can be suppressed from being transferred to the lower face of the inner box 11 by reducing air convection below the inner box 11, and the thermal insulation effect of the double thermal insulation plate 10*a* can thereby be increased. Simultaneously, the flow rate of air above the inner box 11 increases compared with the flow rate of air below the inner box 11, and heat transfer is thereby promoted; thus, the performance of cooling the electric components 52 can be improved.

Although, in the description of Embodiment 1, the lower face of the outer box 12 is positioned on the partition plate 100, and the entire outer box 12 is laid across the fan chamber 110 and the machine chamber 120, this is not the only option. For example, when the entire outer box 12 is provided in the machine chamber 120, the thermal insulation performance is preferably improved by also using resin for the side face, of the outer box 12, that faces the partition plate 100. This configuration is for suppressing heat transfer from the partition plate 100. Note that, even when the outer box 12 is laid across the fan chamber 110 and the machine chamber 120 as in Embodiment 1, any one or more of faces, other than the lower face, of the outer box 12 may also be made of resin.

Moreover, higher thermal insulation performance can be achieved not only by using resin for a portion of the outer box 12 but also by applying a coating having a low emissivity for radiation suppression.

Although Embodiment 1 includes a part, such as the "electric component box", the "inner box", or the "outer box", referred to as a "box", such a part is not necessarily limited to an independent part whose six faces are constituted by walls. Specifically, such a box part may have a box shape constituted by combining plural components rather than a single component or may be a box part from which a portion of a side wall is removed as with the "outer box 12" of Embodiment 1.

Moreover, although the compressor 7 and the reactor 8 are described as heat-generating components in Embodiment 1, this is not the only option. For example, as a heat-generating component, heat generation of the compressor 7 may only be considered when the reactor 8 generates a small amount of heat. When the reactor 8 generates a small amount of heat as described above, there may be an option of disposing the reactor 8 in the inner box 11 of the electric component box 10. With the sealed space formed by the inner box 11, the outdoor unit 1000 configured as described above can exhibit an effect of suppressing an electric noise that is generated from the reactor 8.

Embodiment 2

Figure 7:
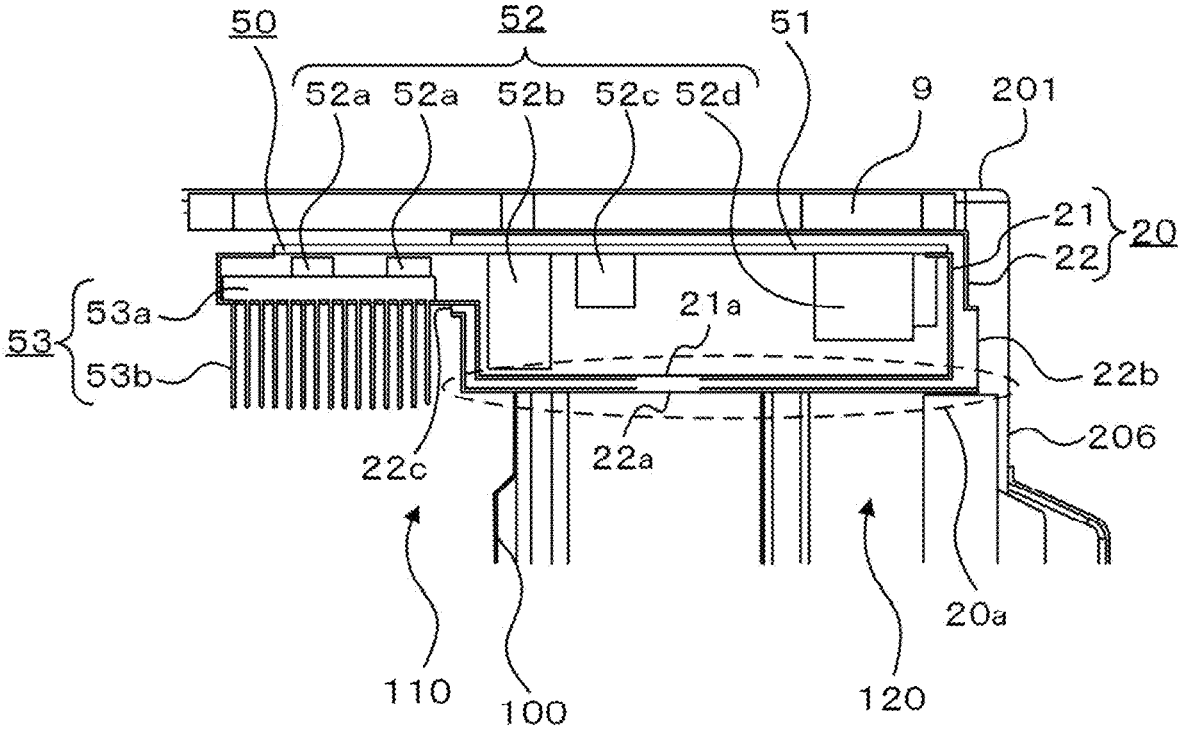
FIG. 7 is a front view of a part A-equivalent part of an outdoor unit of Embodiment 2.
Figure 8:
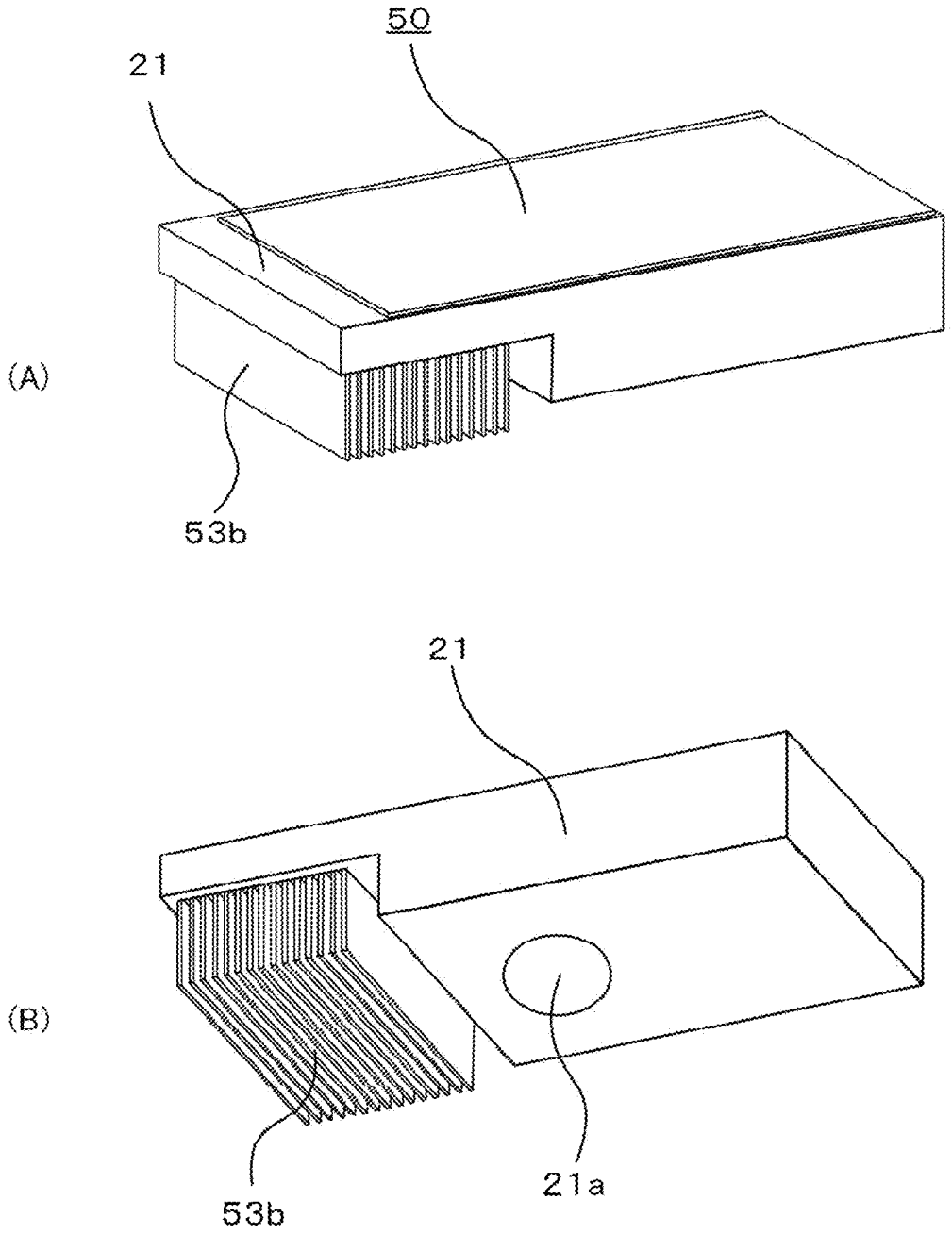
FIG. 8 includes perspective views of an electric component box provided in the outdoor unit of Embodiment 2.

An outdoor unit for an air-conditioning apparatus of Embodiment 2 will be described with reference to FIG. 7 and FIG. 8. FIG. 7 is a front view of a part, of the outdoor unit of Embodiment 2, equivalent to part A in FIG. 1. FIG. 8 includes perspective views of an inner box 21 of an electric component box 20 provided in the outdoor unit of Embodiment 2.

As FIG. 7 illustrates, the outdoor unit of Embodiment 2 differs from the outdoor unit of Embodiment 1 in that the electric component box 20 is provided instead of the electric component box 10 provided in part A of the outdoor unit 1000 of Embodiment 1. The configurations of the other parts are similar to the configurations of the equivalent parts of the outdoor unit 1000 of Embodiment 1, and such a difference is thus mainly described below.

As FIG. 7 illustrates, the electric component box 20 is constituted by the inner box 21 and an outer box 22. The electric component box 20 includes a double thermal insulation plate 20*a* constituted by a lower face of the inner box 21 (first thermal insulation plate) and a lower face of the outer box 22 (second thermal insulation plate). The electric components 52 of the electric board 50 are accommodated in the inner box 21, and the printed circuit board 51 is exposed outside the inner box 21. The outer box 22 covers at least a portion of the inner box 21 on the machine chamber side and a portion of the printed circuit board 51 on the machine chamber side.

As FIG. 7 illustrates, the inner box 21 is laid across the fan chamber 110 and the machine chamber 120. As with the inner box 11 of Embodiment 1, a portion of the lower face of the inner box 11 on the machine chamber side has a pull-out port portion 21*a* for the electric wires. The inner box 21 differs from the inner box 11 of Embodiment 1 in that the printed circuit board 51 constituting the electric board 50 is exposed outside the inner box 21.

More specifically, as FIG. 8 (A) illustrates, the printed circuit board 51 constituting the electric board 50 also serves as an upper lid of the inner box 21. An upper face of the inner box 21 has an opening having sides, each of the sides is about 10 mm smaller than the outside shape of the printed circuit board 51, and the printed circuit board 51 is supported by a stepped plate of about 10 mm so as not to fall. In addition, corner portions of the printed circuit board 51 may be fixed to the inner box 21 by being screwed. Note that, in FIG. 8 and other figures, some portions of the above-described structures are illustrated in a simple manner, and the inner box 21 does not necessarily have the stepped structure.

As FIG. 7 illustrates, the outer box 22 is laid across the fan chamber 110 and the machine chamber 120. As with the outer box 12 of Embodiment 1, the lower face of the outer box 22 has a pull-out port portion 22*a* for the electric wires. As with the outer box 12 of Embodiment 1, the outer box 22 has an opening 22*b* formed inside the machine chamber 120 and an opening 22*c* formed inside the fan chamber 110.

A uniform gap of about 5 mm is formed between the inner box 21 and the outer box 22. However, each of the inner box 21 and the outer box 22 is supported in a fixed manner, and the inner box 21 and the outer box 22 may be in contact with one another in an area at such a support part. As FIG. 7 illustrates, such a space between the inner box 21 and the outer box 22 allows the air that flows from the opening 22*b* and passes through the space between the inner box 21 and the outer box 22, to flow out through the opening 22*c*. That is, the machine chamber 120 and the fan chamber 110 are considered to communicate with one another.

As FIG. 7 illustrates, the electric component box 20 includes the double thermal insulation plate 20*a* constituted by the lower face of the inner box 21 (first thermal insulation plate) and the lower face of the outer box 22 (second thermal insulation plate). The double thermal insulation plate 20*a* is provided between the electric board 50, and the compressor 7 and the reactor 8 that are heat-generating components. More specifically, the double thermal insulation plate 20*a* is disposed above the compressor 7 and the reactor 8 that are provided in the machine chamber 120 and are heat-generating components, and below the electric board 50. As described above, there is a gap (space) of about 5 mm between the lower face of the inner box 21 (first thermal insulation plate) and the lower face of the outer box 22 (second thermal insulation plate) that constitute the double thermal insulation plate 20*a*. Moreover, the lower face of the inner box 21 (first thermal insulation plate) is made of, for example, a metal material, and the lower face of the outer box 22 (second thermal insulation plate) is made of, for example, a resin material. That is, the lower face of the outer box 22 (second thermal insulation plate) is made of a material having a lower thermal conductivity than the lower face of the inner box 21 (first thermal insulation plate).

The electric board 50 has a configuration similar to the configuration of the electric board 50 of Embodiment 1. However, as FIG. 7 and FIG. 8 illustrate, in the outdoor unit of Embodiment 2, the printed circuit board 51 of the electric board 50 is exposed outside the inner box 21, and the inner box 21, the printed circuit board 51, and the heat sink base plate 53*a* of the heat sink 53 form a sealed space.

Here, in the detailed description of the electric board 50, the electric components 52 are disposed on a lower face of (on the lower side relative to) the printed circuit board 51, and solder parts of the electric components 52 are provided on an upper face of (on the upper side relative to) the printed circuit board 51. In Embodiment 2, the electric board 50 is exposed outside the inner box 21. Thus, to protect the solder parts of the electric components 52, the upper surface of the electric board 50, that is, a surface serving as the upper surface of the printed circuit board 51 and exposed from the inner box 21 is applied with a moisture-proof insulating coating. The material of the coating is, for example, a urethane resin.

The outdoor unit of Embodiment 2 configured as described above also exhibits effects similar to the effects of the outdoor unit 1000 of Embodiment 1.

In addition, in the outdoor unit of Embodiment 2, a surface of the electric board 50 is exposed from the inner box 21, and the air that has flowed in though the opening 22*b* of the outer box 22 thereby blows directly against the upper surface of the electric board 50. Accordingly, heat transfer of the electric components 52 is further promoted, and the outdoor unit of Embodiment 2 can exhibit an effect of improving the reliability.

Moreover, in the outdoor unit of Embodiment 2, the electric board 50 and the inner box 21 are formed as one body, and the outdoor unit of Embodiment 2 can thus exhibit an effect of reduction in size of the electric component box 20.

Embodiment 3

Figure 9:
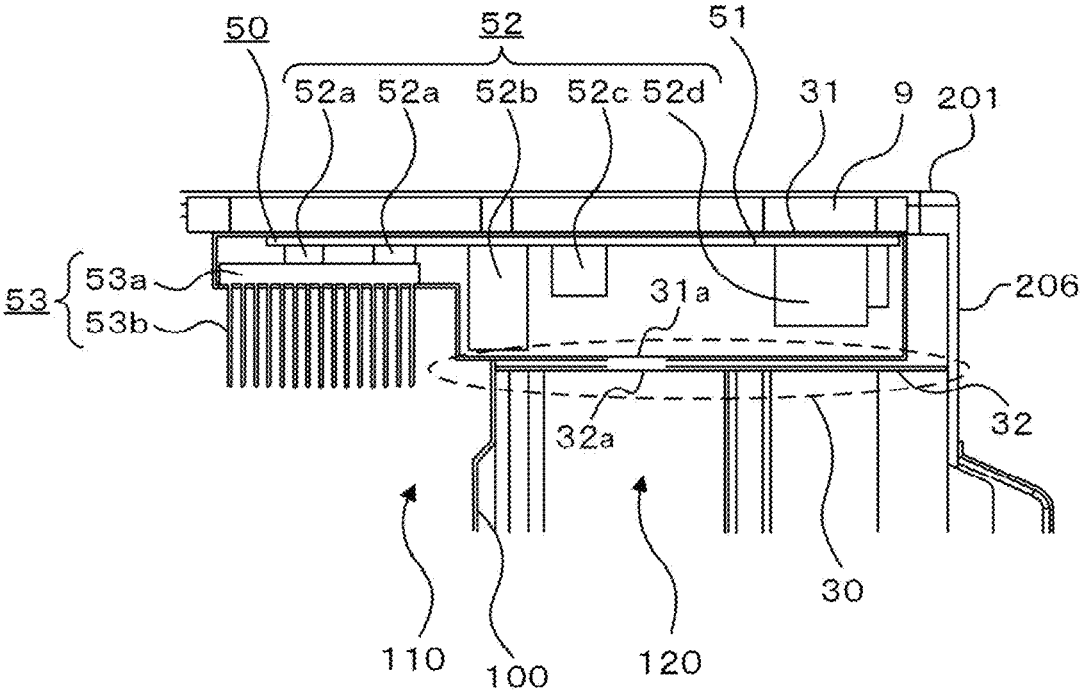
FIG. 9 is a front view of a part A-equivalent part of an outdoor unit of Embodiment 3.

An outdoor unit for an air-conditioning apparatus of Embodiment 3 will be described with reference to FIG. 9. FIG. 9 is a front view of a part, of the outdoor unit of Embodiment 3, equivalent to part A in FIG. 1.

As FIG. 9 illustrates, the outdoor unit of Embodiment 3 differs from the outdoor unit of Embodiment 1 in that an electric component box 31 is provided instead of the electric component box 10 provided in part A of the outdoor unit 1000 of Embodiment 1, and a double thermal insulation plate 30 is constituted by a lower face of the electric component box 31 (first thermal insulation plate) and a thermal insulation plate 32 (second thermal insulation plate). The configurations of the other parts are similar to the configurations of the equivalent parts of the outdoor unit 1000 of Embodiment 1, and such a difference is thus mainly described below.

As FIG. 9 illustrates, the electric component box 31 is equivalent to the inner box 11 of the electric component box 10 of Embodiment 1. That is, the electric component box 31 has no constituent equivalent to the outer box 12 of the electric component box of Embodiment 1.

As FIG. 9 illustrates, the electric component box 31 is laid across the fan chamber 110 and the machine chamber 120. As with the inner box 11 of Embodiment 1, a portion of the lower face of the electric component box 31 on the machine chamber side has a pull-out port portion 31*a* for the electric wires. The electric board 50 is accommodated in the electric component box 31.

In addition, the thermal insulation plate 32 is provided below the electric component box 31. The thermal insulation plate 32 is a plate-shaped component equivalent to the lower face of the outer box 12 of Embodiment 1 and is provided on the machine chamber side. The thermal insulation plate 32 (second thermal insulation plate) is preferably made of a resin having a low thermal conductivity. As with the outer box 12 of Embodiment 1, the thermal insulation plate 32 has a pull-out port portion 32*a* for the electric wires.

A uniform gap of about 5 mm is formed between the lower face of the electric component box 31 and the thermal insulation plate 32. As described above, the outdoor unit of Embodiment 3 includes the double thermal insulation plate 30 constituted by the lower face of the electric component box 31 (first thermal insulation plate) and the thermal insulation plate 32 (second thermal insulation plate). The double thermal insulation plate 30 is provided between the electric board 50, and the compressor 7 and the reactor 8 that are heat-generating components. More specifically, the double thermal insulation plate 30 is disposed above the compressor 7 and the reactor 8 that are provided in the machine chamber 120 and are heat-generating components, and below the electric board 50. As described above, there is a gap (space) of about 5 mm between the lower face of the electric component box 31 (first thermal insulation plate) and the thermal insulation plate 32 (second thermal insulation plate) that constitute the double thermal insulation plate 30. Moreover, the lower face of the electric component box 31 (first thermal insulation plate) is made of, for example, a metal material, and the thermal insulation plate 32 (second thermal insulation plate) is made of, for example, a resin material. That is, the thermal insulation plate 32 (second thermal insulation plate) is made of a material having a lower thermal conductivity than the lower face of the electric component box 31 (first thermal insulation plate).

In addition, in Embodiment 3, an inlet port is not necessarily formed in the side panel 206 of the housing 200. This is because Embodiment 3 has a structure in which the electric component box 31 has a single structure and in which air does not flow between the electric component box 31 and the thermal insulation plate 32. Even with such a structure, the double thermal insulation plate 30 forms a thermal insulation layer of air, and the heat insulation between the heat-generating components and the electric board 50 is thereby improved. Accordingly, the reliability of the outdoor unit can be improved.

The outdoor unit of Embodiment 3 configured as described above also exhibits effects similar to the effects of the outdoor unit 1000 of Embodiment 1.

In addition, in the outdoor unit of Embodiment 3, the electric component box 31 is equivalent to the inner box 11 of Embodiment 1, and the outdoor unit of Embodiment 3 can thus exhibit an effect of reduction in size of the electric component box 31.

Note that, although the electric component box 31 and the thermal insulation plate 32 are described as separated constituents in Embodiment 3, an electric component box may be constituted by the electric component box 31 and the thermal insulation plate 32 that are formed as one body. That is, the lower face of the electric component box has a structure of a double thermal insulation plate constituted by a first thermal insulation plate and a second thermal insulation plate. Such a configuration also exhibits similar effects.

Embodiment 4

Figure 10:
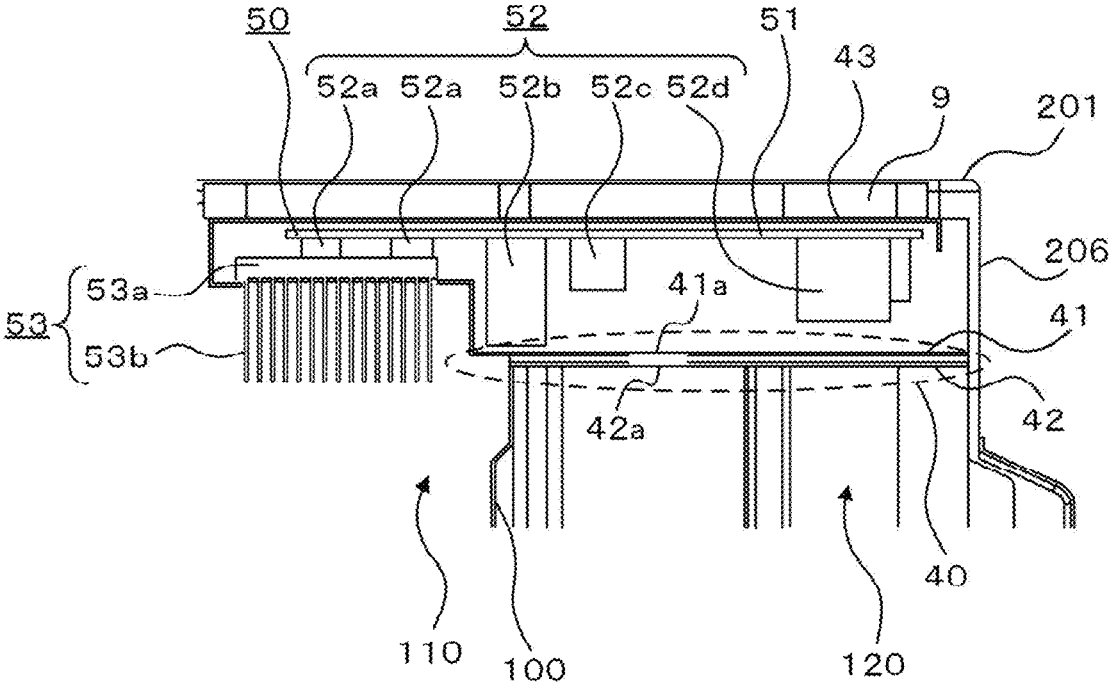
FIG. 10 is a front view of a part A-equivalent part of an outdoor unit of Embodiment 4.

An outdoor unit for an air-conditioning apparatus of Embodiment 4 will be described with reference to FIG. 10. FIG. 10 is a front view of a part, of the outdoor unit of Embodiment 4, equivalent to part A in FIG. 1.

As FIG. 10 illustrates, the outdoor unit of Embodiment 4 differs from the outdoor unit of Embodiment 1 in that a heat sink holder 43 and a double thermal insulation plate are provided instead of the electric component box 10 provided in part A of the outdoor unit 1000 of Embodiment 1. The configurations of the other parts are similar to the configurations of the equivalent parts of the outdoor unit 1000 of Embodiment 1, and such a difference is thus mainly described below.

As FIG. 10 illustrates, the heat sink holder 43 laid across the fan chamber 110 and the machine chamber 120 surrounds the periphery of the heat sink 53 and supports the electric board 50. Note that, although a configuration in which the heat sink holder 43 covers the entire printed circuit board 51 is given here, this is not the only option, and any heat sink holder covering at least a portion of the printed circuit board 51 on the heat sink 53 side, that is, the fan chamber 110 side may suffice.

The double thermal insulation plate 40 is constituted by an upper thermal insulation plate 41 (first thermal insulation plate) and a lower thermal insulation plate 42 (second thermal insulation plate). Each of the upper thermal insulation plate 41 (first thermal insulation plate) and the lower thermal insulation plate 42 (second thermal insulation plate) has a plate shape. The double thermal insulation plate 40 is provided between the electric board 50, and the compressor 7 and the reactor 8 that are heat-generating components. More specifically, the double thermal insulation plate 40 is disposed above the compressor 7 and the reactor 8 that are provided in the machine chamber 120 and are heat-generating components, and below the electric board 50. In addition, there is a gap (space) of about 5 mm between the upper thermal insulation plate 41 (first thermal insulation plate) and the lower thermal insulation plate 42 (second thermal insulation plate) that constitute the double thermal insulation plate 40.

As with the inner box 11 of Embodiment 1, the upper thermal insulation plate 41 has a pull-out port portion 41*a* for the electric wires. In addition, as with the thermal insulation plate 32 of Embodiment 3, the lower thermal insulation plate 42 provided below the upper thermal insulation plate 41 has a pull-out port portion 42*a* for the electric wires. In the upper thermal insulation plate 41 and the lower thermal insulation plate 42, at least the lower thermal insulation plate 42 is preferably made of a resin material having a low thermal conductivity. That is, the lower thermal insulation plate 42 (second thermal insulation plate) is preferably made of a material having a lower thermal conductivity than the upper thermal insulation plate 41 (first thermal insulation plate).

In addition, in Embodiment 4, an inlet port is not necessarily formed in the side panel 206 of the housing 200. This is because a feature of Embodiment 4 is that the thermal insulation performance is improved by the double thermal insulation plate 40, and, in the structure of Embodiment 4, no air flows through a space between the plates of the double thermal insulation plate 40.

Note that the upper thermal insulation plate 41 and the lower thermal insulation plate 42 that constitute the double thermal insulation plate 40 may also be coupled to one another at plural in-plane points by using, for example, ribs to maintain the rigidity of the double thermal insulation plate 40. Note that heat from below can be effectively stopped by using a resin having a low thermal conductivity for the ribs.

The outdoor unit of Embodiment 3 configured as described above also exhibits effects similar to the effects of the outdoor unit 1000 of Embodiment 1.

Note that, in Embodiments 1 to 4, combining, modifying, or omitting as appropriate is also included in the scope of the present disclosure.

REFERENCE SIGNS LIST

2: heat exchanger, 3: fan, 4: support board, 5: bell mouth, 5*a*: protruding portion, 7: compressor (heat-generating component), 7*a*: vibration-proof rubber, 8: reactor (heat-generating component), 9: cushioning, 10, 20, 31: electric component box, 10*a*, 20*a*, 30, 40: double thermal insulation plate, 11, 21: inner box, 12, 22: outer box, 32: insulation plate (second thermal insulation plate), 41: upper thermal insulation plate (first thermal insulation plate), 42: lower thermal insulation plate (second thermal insulation plate), 43: heat sink holder, 50: electric board, 51: printed circuit board, 52: electric component, 52*a*: power source control component, 52*b*: capacitor, 52*c*: resistor, 52*d*: coil, 53: heat sink, 53*a*: heat sink base plate, 53*b*: heat transfer fin, 100: partition plate, 110: fan chamber, 120: machine chamber, 200: housing, 201: top panel, 202: bottom panel, 203: front panel, 204: back panel, 205, 206: side panel, 1000: outdoor unit

The invention claimed is:

1. An outdoor unit for an air-conditioning apparatus, the outdoor unit comprising:

a housing whose inside is divided into a fan chamber and a machine chamber by a partition plate;

a heat exchanger provided in the fan chamber;

a fan that sucks air from outside the housing into the fan chamber;

a heat-generating component provided in the machine chamber;

an electric board provided above the heat-generating component and including a printed circuit board and an electric component; and a double thermal insulation plate provided between the heat-generating component and the electric board and including a first thermal insulation plate and a second thermal insulation plate disposed below the first thermal insulation plate with a space interposed between the first thermal insulation plate and the second thermal insulation plate.

2. The outdoor unit for an air-conditioning apparatus of claim 1, wherein the double thermal insulation plate is provided above the heat-generating component and below the electric board.

3. The outdoor unit for an air-conditioning apparatus of claim 1, wherein the second thermal insulation plate is made of a material having a lower thermal conductivity than the first thermal insulation plate.

4. The outdoor unit for an air-conditioning apparatus of claim 1, wherein each of the first thermal insulation plate and the second thermal insulation plate has a plate shape.

5. The outdoor unit for an air-conditioning apparatus of claim 1, wherein a portion of an electric component box accommodating the electric board constitutes at least a portion of the double thermal insulation plate.

6. The outdoor unit for an air-conditioning apparatus of claim 5, wherein the electric component box forms a sealed space accommodating at least the electric component of the electric board.

7. The outdoor unit for an air-conditioning apparatus of claim 6, wherein the electric component includes a power source control component to which a heat sink is attached, the heat sink includes a heat transfer fin exposed from the electric component box, and the electric component box forms the sealed space together with a portion of the heat sink.

8. The outdoor unit for an air-conditioning apparatus of claim 6, wherein the electric component box includes an inner box having a lower face that constitutes the first thermal insulation plate and forming the sealed space and an outer box having a lower face that constitutes the second thermal insulation plate, surrounding at least a portion, of the inner box, closer to the machine chamber, and having an opening closer to the machine chamber and an opening closer to the fan chamber, a space is formed between the inner box and the outer box, and, by operation of the fan, air is sucked from outside the housing into the space via the machine chamber and flows into the fan chamber.

9. The outdoor unit for an air-conditioning apparatus of claim 8, wherein the printed circuit board is exposed from the inner box of the electric component box.

* * * * *